United States Patent [19]

Ashley

[11] 4,451,040

[45] May 29, 1984

[54] TABULAR PUZZLE

[76] Inventor: Jonathan J. Ashley, 3367 N. McCall, Sanger, Calif. 93657

[21] Appl. No.: 391,165

[22] Filed: Jun. 22, 1982

[51] Int. Cl.[3] ..... A63F 9/08

[52] U.S. Cl. ..... 273/153 S; 273/281

[58] Field of Search ..... 273/153 S, 155, 281

[56] References Cited

U.S. PATENT DOCUMENTS 332,211 12/1885 Protheroe ..... 273/153 S

*Primary Examiner*—Anton O. Oechsle

[57] ABSTRACT

The tabular puzzle, shown in FIG. 5, is a puzzle comprising nine square tablets arranged in a three-by-three array and inclosed in a mechanism in such a way that any group of four tablets meeting at a common corner point may be rotated about said point by any multiple of 90°. The exposed face of each of the tablets is marked with an index which uniquely establishes said tablet's identity and orientation. These indices may be scrambled by a series of said rotations. The object of the puzzle is to return the tablets, and hence the indices, to their original positions and orientations in the said three-by-three array by means of a series of said rotations.

1 Claim, 7 Drawing Figures

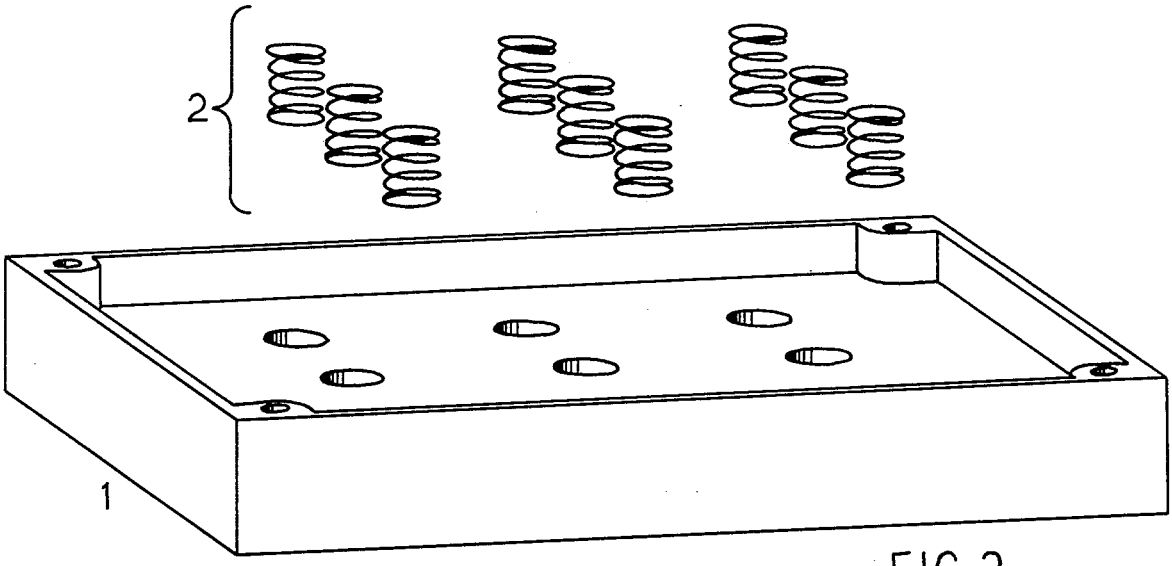
FIG. 2
FIG. 3
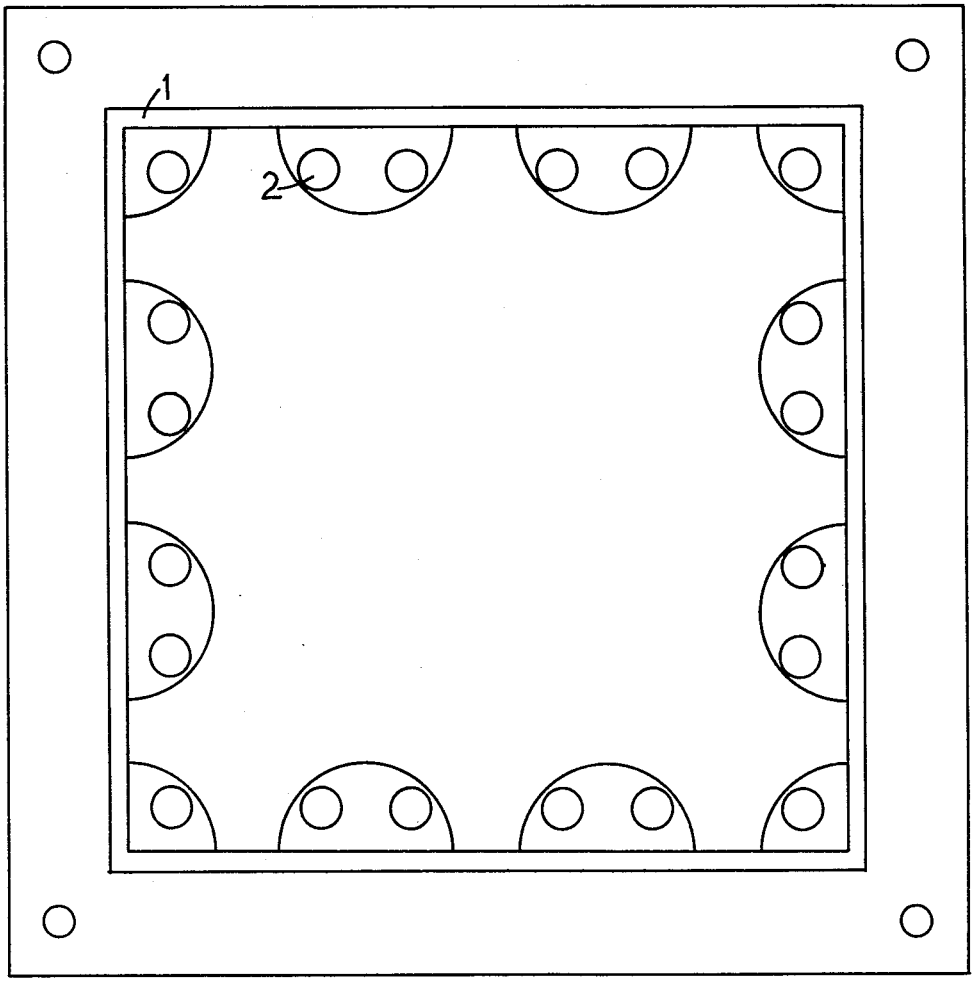

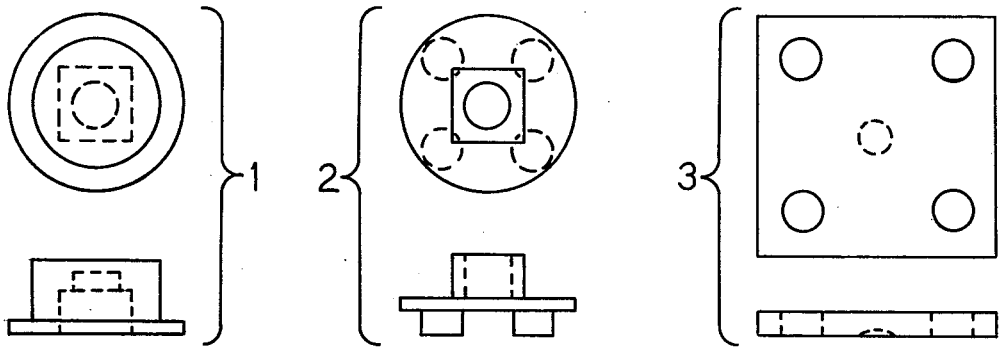
FIG. 4
FIG. 5
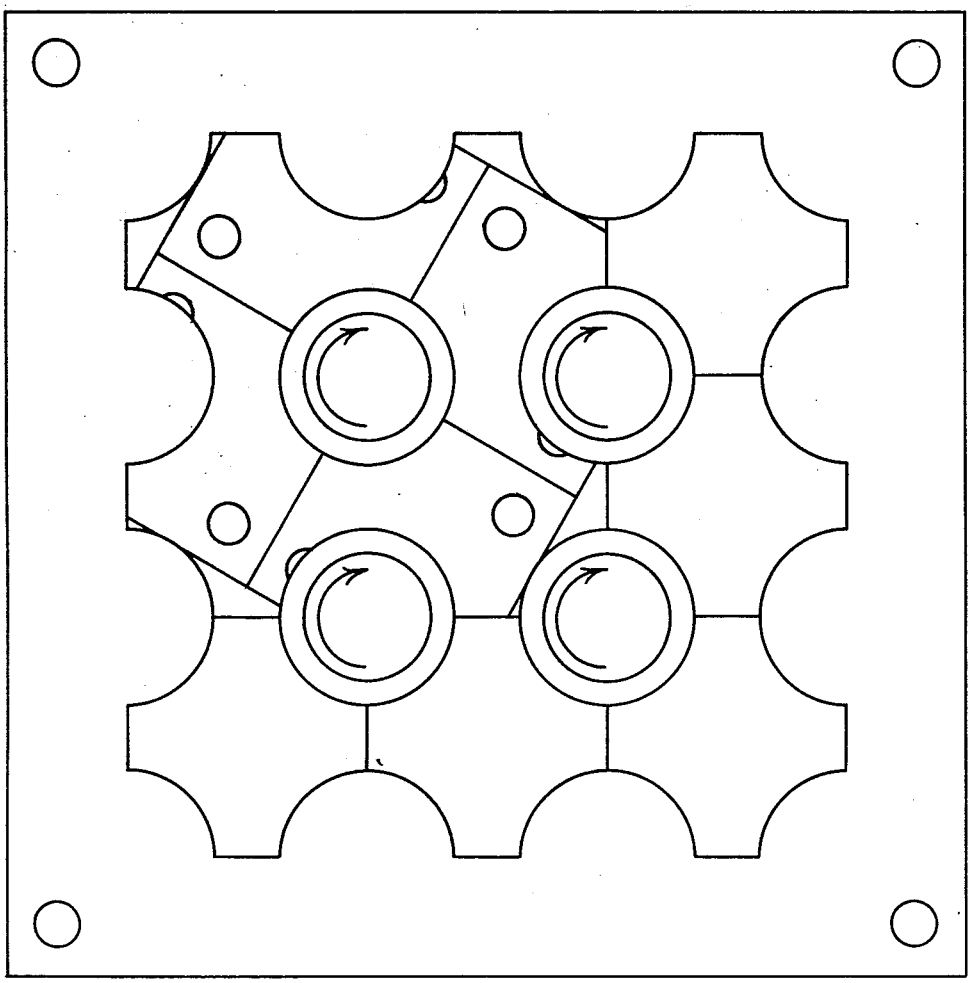

TABULAR PUZZLE

SUMMARY OF THE INVENTION

The invention, shown in exploded view in FIGS. 1 and 2 and shown assembled in FIG. 7, is a puzzle comprising nine identically shaped square tablets and four knobs inclosed in a front plate, a frame, and a tray. Said tablets are arranged in a three-by-three array. One of said knobs is located at each of the four points of this array where four tablets have a common corner. A mechanism, described below, is provided so that one may depress any one of the knobs by a distance equal to the thickness of said tablets and then rotate said knob along with its four surrounding tablets by any angle. When said knob is rotated by some integer multiple of 90° and then released, said knob will pop up to its original height and its four surrounding tablets will pop up to the level of the remaining tablets. Such a procedure—depression, rotation, and popping up of one of said knobs—constitutes a move in scrambling or unscrambling the nine tablets and the indices with which their exposed faces are marked. The object of the puzzle is to return the tablets, and hence the indices, to their original positions and orientations in the said three-by-three array by means of a series of said moves.

BRIEF DESCRIPTION OF THE DRAWINGS

FIGS. 1 and 2 show an exploded view of all of the components of the puzzle. FIG. 2 is a continuation of FIG. 1.

FIG. 3 shows the underside of the frame against which the tablets are retained.

FIGS. 4, 5, and 6 show top and side views of a knob, a knob base, and a tablet, respectively:

FIG. 7 shows a top view of the assembled puzzle with the upper-left knob depressed and turned 30° clockwise.

DESCRIPTION OF THE PREFERRED IMBODIMENT

Figure 1:
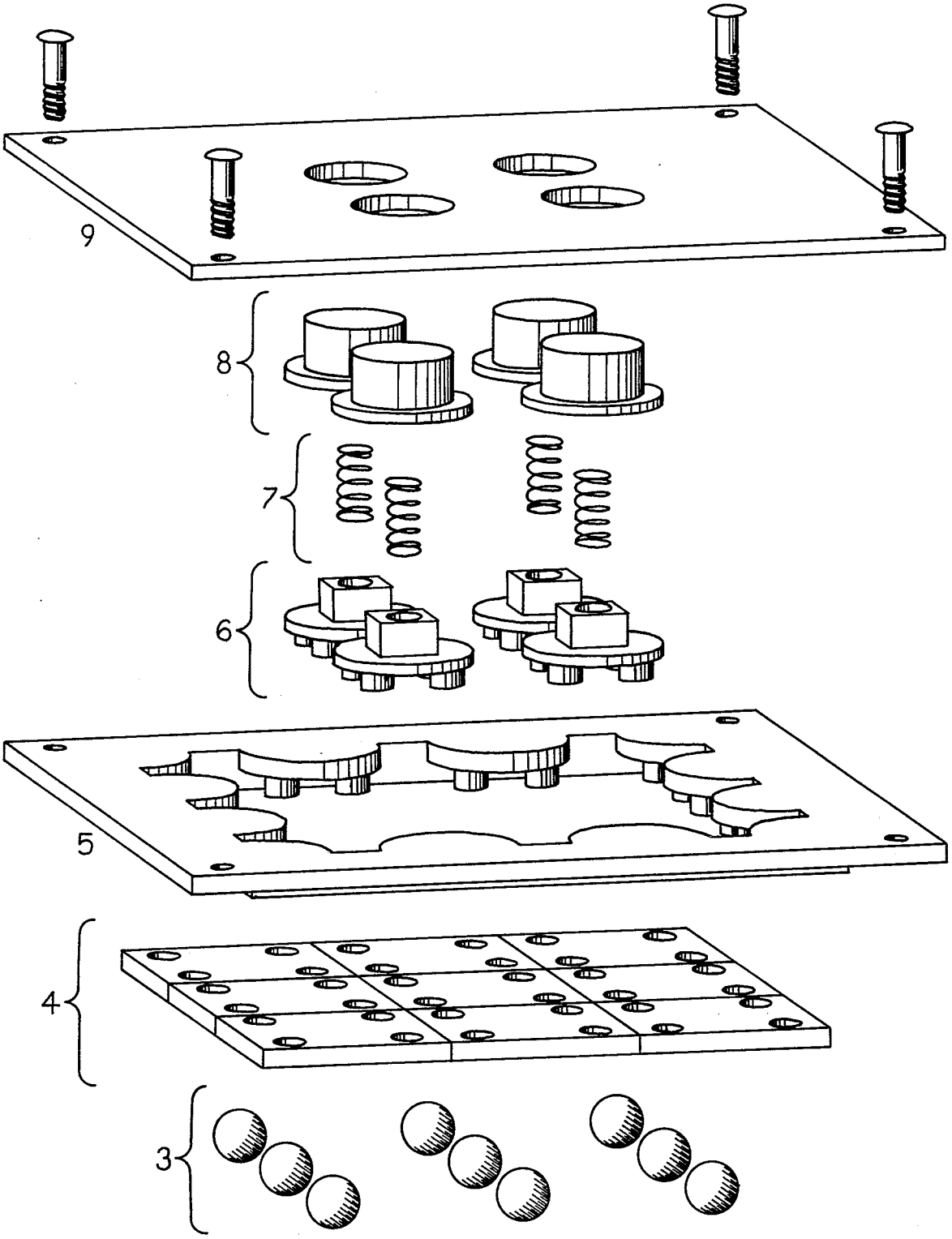

FIGS. 1 and 2 show an exploded view of all of the components of the puzzle. FIG. 2 shows the tray 1 and nine springs 2 which are inserted in nine cylindrical wells in the floor of tray 1. The height of the rim of tray 1 above its floor is slightly more than twice the thickness of said tablets. FIG. 1 shows the remaining components of the puzzle. Said nine springs exert pressure against nine ball bearings 3 which in turn exert pressure against nine square tablets 4 in order to retain said tablets 4 against frame 5 and against four knob bases 6. Each of said tablets 4 has a circular hole running through it near each of its four corners. These holes engage circular pegs of length equalling the thickness of said tablets projecting from said frame 5 and from said knob bases 6. Four springs 7 provide compressive tension between said knob bases 6 and four knobs 8 which said knob bases 6 engage. A transparent front panel 9 retains said four knobs 8 against said knob bases 6.

FIG. 3 shows the underside of the frame against which said tablets are retained. The height of the rim 1 and pegs 2 above the rest of the underside is equal to the thickness of said tablets.

FIGS. 4, 5, and 6 show top and side views of a knob, a knob base, and a tablet, respectively. The knob-spring-knob base assembly is designed so that even when a knob is depressed, thus depressing its four surrounding tablets, then turned by any angle, then pulled upward, the knob base pegs remain engaged in the holes of the four still depressed surrounding tablets and the knob base remains engaged in said knob, thus insuring that said four tablets remain centered under said knob. The tablet has a dimple in the center of its rear, unexposed surface which, in an unturned position of said tablet, engages an underlying ball bearing. Said dimples serve as click stops for 90° rotations of the knobs.

FIG. 7 shows a top view of the assembled puzzle with the upper-left knob, along with its four surrounding tablets, depressed by a distance equal to the thickness of the tablets and turned 30° to the right. Note that in this position the four ball bearings underlying the four upper-leftmost tablets are also depressed into their cylindrical wells and against their springs.

The foregoing is considered as illustrative only of the principles of the invention. Further, since numerous modifications and changes will readily occur to those skilled in the art, it is not desired to limit the invention to the exact construction shown and described, and accordingly all suitable modifications and equivalents may be resorted to, falling within the scope of the invention as claimed. In particular, it is not desired to limit the dimensions of the array of tablets to three tablets by three tablets. It is clear that the construction shown and described can be generalized to an n-by-m array of tablets with $(n-1)\times(m-1)$ knobs, where n and m are any integers greater than one.

What is claimed as new is as follows:

1. A puzzle comprising a rectangular array of square tablets inclosed in a frame and a tray, each of said tablets being marked with an index which establishes its identity and orientation; a number of knobs, one being at each point of said array where four tablets meet at a common corner, each of said knobs engaging its surrounding four tablets and, upon being depressed and rotated, depressing and rotating said four surrounding tablets, and, upon being released after a rotation by some multiple of 90°, popping up along with said four surrounding tablets to its original level above said tray.

* * * * *